United States Patent [19]

Ohue et al.

[11] 4,094,140

[45] June 13, 1978

[54] TIMEPIECE-GAS LIGHTER ASSEMBLY

[76] Inventors: Hideki Ohue, 3-6-13, Kitaurawa, Urawa-shi, Saitama-ken; Masatoshi Katayama, 1-650, Higashiohnari, Ohmiya-shi, Saitama-ken, both of Japan

[21] Appl. No.: 717,342

[22] Filed: Aug. 24, 1976

[51] Int. Cl.[2] ..... G04B 37/12

[52] U.S. Cl. ..... 58/152 R; 58/50 R; 361/256

[58] Field of Search ..... 58/23 R, 23 BA, 52–55, 58/88 R, 88 E, 152 R; 219/267, 268; 361/256

[56] References Cited

U.S. PATENT DOCUMENTS

| | | | |
|---|---|---|---|
| 2,576,476 | 11/1951 | Peter et al. | 58/88 R |
| 2,598,701 | 6/1952 | Kaufmann | 58/50 R X |
| 3,747,322 | 7/1973 | Eckenrode | 58/50 R |
| 3,813,533 | 5/1974 | Cone et al. | 58/150 R |
| 3,883,246 | 5/1975 | Maire et al. | 361/256 X |
| 3,889,160 | 6/1975 | Cobarg | 361/256 |
| 3,974,638 | 8/1976 | Haber | 58/50 R |
| 4,023,922 | 5/1977 | Goto | 361/256 |

FOREIGN PATENT DOCUMENTS

| | | | |
|---|---|---|---|
| 2,059,730 | 6/1972 | Germany | 58/152 R |

*Primary Examiner*—Edith S. Jackmon
*Attorney, Agent, or Firm*—Fleit & Jacobson

[57] ABSTRACT

A combination of an electronic timepiece with a liquefied gas fueled cigarette lighter is proposed. A common source battery is used for the bath main constituents. The spark ignition circuit for the gas lighter is fitted with a diode for the prevention of otherwise possible electrical switching shock as appearing during the on-off control of the high voltage spark generation for igniting the fuel gas. Several points of the overall circuit are positively earthed for the same purpose.

6 Claims, 9 Drawing Figures

TIMEPIECE-GAS LIGHTER ASSEMBLY

BACKGROUND OF THE INVENTION

This invention relates to improvements in and relating to the timepiece-liquefied gas fueled cigaret lighter assembly. The above type lighter will be briefly referred to as "gas lighter" throughout the specification and appended claims.

Combination units of mechanical watch with the gas lighter are hitherto known broadly in the art. In the latest decade, mechanical watches are being gradually and at least partially replaced by semi- or full-electronic timepieces having a drive battery in place of a power spring. On the other hand, the ignition mechanism of a gas lighter has developed from the old-fashioned flint wheel type through the piezoelectric type to the high voltage spark discharge electrode type.

Modern electronic digital display timepieces having a quartz crystal oscillator as its precision timebase may be classified into two major categories. One is the liquid crystal display type and the other is the luminescence diode display type. In the former, hereinafter to be called "LCD" type throughout this specification, the display is not visible per se to human eyes when the background is dark. Conventionally, a switch is provided for igniting a small electric lamp for illuminating the display surface by closing the switch directly by finger pressure, gravity action or indirectly by human skin touch. In this case, electrical switching shock will be transmitted from the flame-generating side to the precision timebase side, giving rise to a disturbed operation thereof. The same can be applied to the electronic analogue timepieces having a similar precision timebase. Frequent ignition of such specifically provided electric lamp will consume rapidly the self-containing timepiece battery.

In the latter category timepiece, hereinafter to be called "LED" type throughout this specification, there is provided no such illuminating electric lamp, since the display operates per se illuminatingly. In this case, however, special caution must be made to provide inhibiting means to prevent the same kind of switching shock transfer as above.

It is, however, the Applicants' intention to limit the present invention only to these shown and illustrated embodiments. Obvious equivalent means can also be included without departing from the appended claims.

It is an object of the invention to provide an efficient flame light source, in place of the electric lamp, to the LCD-type timepiece display means.

A further object is to provide an improved and optimal assembly of the battery-driven timepiece with the battery-powered gas lighter provided with igniting high voltage spark electrodes.

Still a further object is to provide the assembly of the above kind which is highly compact in its outline configuration and efficient in its igniting operation.

In the present invention, a common battery is employed for a combination assembly of an electronic timebase with a battery powered gas lighter.

Further, according to this invention, the electric illuminating lamp is replaced by an on-off controllable flame light source, for economizing the battery power consumption.

These and further objects, features and advantages of the invention will become more apparent when reading the following detailed description of the invention with reference to the accompanying drawings illustrative of several preferred embodiments of the invention.

DETAILED DESCRIPTION OF PREFERRED EMBODIMENTS

Figure 1:
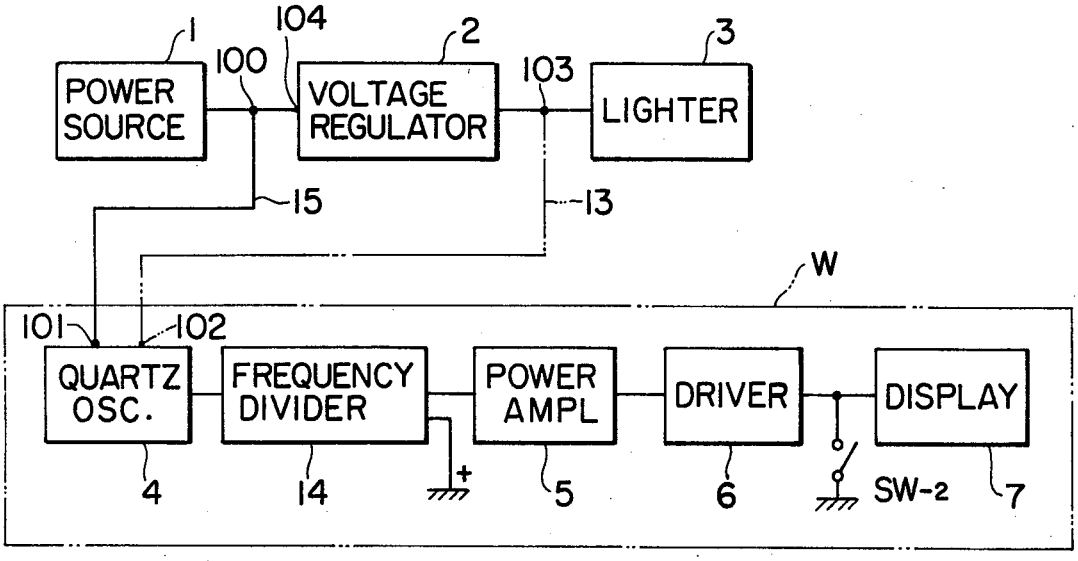
FIG. 1 is a basic electronic circuit of the timepiece - gas lighter assembly of the present invention, being shown in a block diagram.

In FIG. 1, a basic electronic circuit used in the inventive assembly is shown in a block diagram. In this diagram, numeral 1 represents a power source battery of three volts. The output current from this power source is delivered through a junction 100 to voltage regulator 2 and to first input 101 of a quartz oscillator 4, respectively. The output from the voltage regulator 2 is fed through a junction 103 to a liquefied gas lighter section 3 which is a main component of the assembly to be described, and to second input 102 through a branch line 13. When the second input 102 is utilized, the branch line 15 connecting the first junction 100 and the first input 101 may be dispensed with.

The quartz oscillator 4 is connected electrically with a frequency divider 14, power amplifier 5, driver 6 and display unit 7 in succession. All these units 4; 14; 5; 6 and 7 are included in a timepiece section or watch module as shown in FIG. 1 by a chaindotted line block W.

Figure 2:
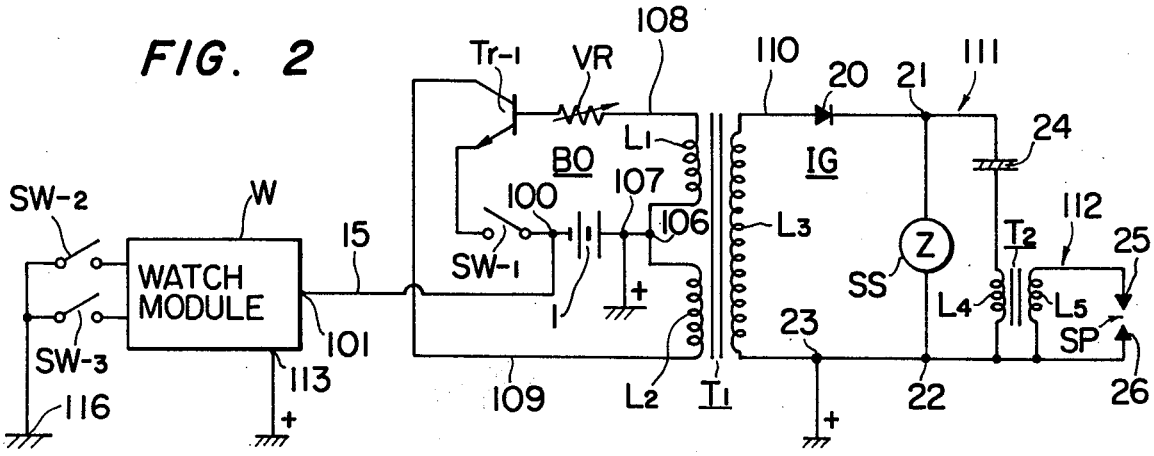
FIG. 2 is a more specific connection diagram of the circuit embodied in the invention.

A more specific circuit is shown in FIG. 2.

In this figure, a watch module is shown by a block W which is similar to the timepiece section shown in FIG. 1. In this case, the voltage regulator represents a blocking oscillator BO which comprises a switch SW-1, power source 1, a transistor Tr-1, a variable resistor VR, a coil element L1 and junction 100; 106; 107. Junction 107 is positively grounded.

The module W has a time display read-out switch SW-2 and time correction switch SW-3, as known per se. These switches SW-2 and SW-3 are highly conventional in connection with the electronic timepieces, preferably watches. The former one SW-2 may be, however, dispensed with, if the timepiece is of the LCD - display type or alternatively of the analogue display type having time-indicator hands.

At the output from the blocking oscillator circuit BO, or more specifically that from the oscillator transistor Tr-1, 10 volts, 2.5 kHz, is fed to coil element L2 acting as a primary winding of a step-up transformer T1 having a secondary winding L3.

The secondary winding L3 is included in an ignition circuit IG comprising rectifier diode 20, junctions 21 - 23, charging condenser 24, second transformer T2 having primary and secondary windings L4 and L5, and a spark gap SP defined by and between a pair of spark electrodes 25; 26 and normally amounting to 2 - 3 millimeters. A two-directional and two-terminal thyrister SS is inserted between the terminals 21 and 22. The terminal 23 is grounded as shown.

The first or main transformer T1 is designed to step up its primary voltage 10 volts to its secondary voltage 100 volts. On the other hand, the second or sparking transformer T2 is designed to step up its primary voltage 100 volts to its secondary voltage 8,000 volts or so.

Figure 3:
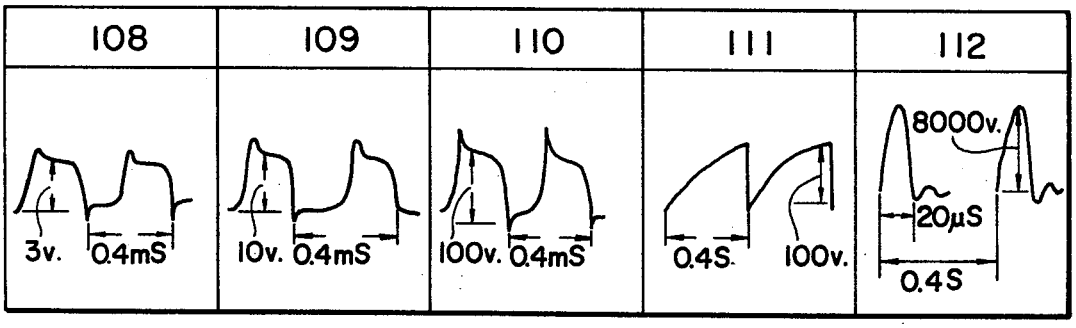
FIG. 3 is a series of voltage wave forms appearing at several places in the circuit shown in FIG. 2.

Several voltage curves appearing at several preferred points 108 - 112 in the circuit shown in FIG. 2 are represented schematically in FIG. 3.

Even if the ignition switch SW-1 is opened as shown, the watch module W can operate as regularly, since current can flow from source battery 1 through junction 107, ground and terminal 113 attached to the said module, to the latter.

If it is assumed that the module is of the LCD-type, and when it is desired to review visually the time display in the dark, ignition switch SW-1 is now closed, so as to energize the blocking oscillator circuit BO. In this way, a high spark voltage of 8,000 volts or so is generated and bridges over the spark gap SP which is comprised in the gas lighter 3 and positioned in close proximity to the gas outlet nozzle thereof as will be more fully described hereinafter with reference to FIGS. 7 - 9. Thus, the gas lighter 3 is ignited and the generated flame is utilized to illuminate the LCD-display surface. This sparking and igniting operation will be repeated until the switch SW-1 will have been reopened. The thyrister SS is so designed that it becomes conductive when the input voltage attains 100 volts. In this way otherwise possible misfire can be obviated.

According to the present invention, a common battery is used for the timepiece and the gas lighter. As was described herein above, the modern gas lighter has a pair of spark electrodes, representing a relatively wider gap distance, normally 2 - 3 millimeters. Therefore, a high ignition voltage, such as 8 - 10 killovolts, must be impressed between the gas-defining electrodes. These ignition voltages are, therefore, substantially higher than the battery voltage which amounts only to 3 volts or so. Means must be therefore, provided for the prevention of transmission of high voltage switching shocks to the precision timebase or more specifically the quartz oscillator 4. As the first safety measure for this purpose, the diode 20 acts well.

As the second safety means, the positive ground connection provided at 23; 107 and 113 serve well for the purpose.

Figure 4:
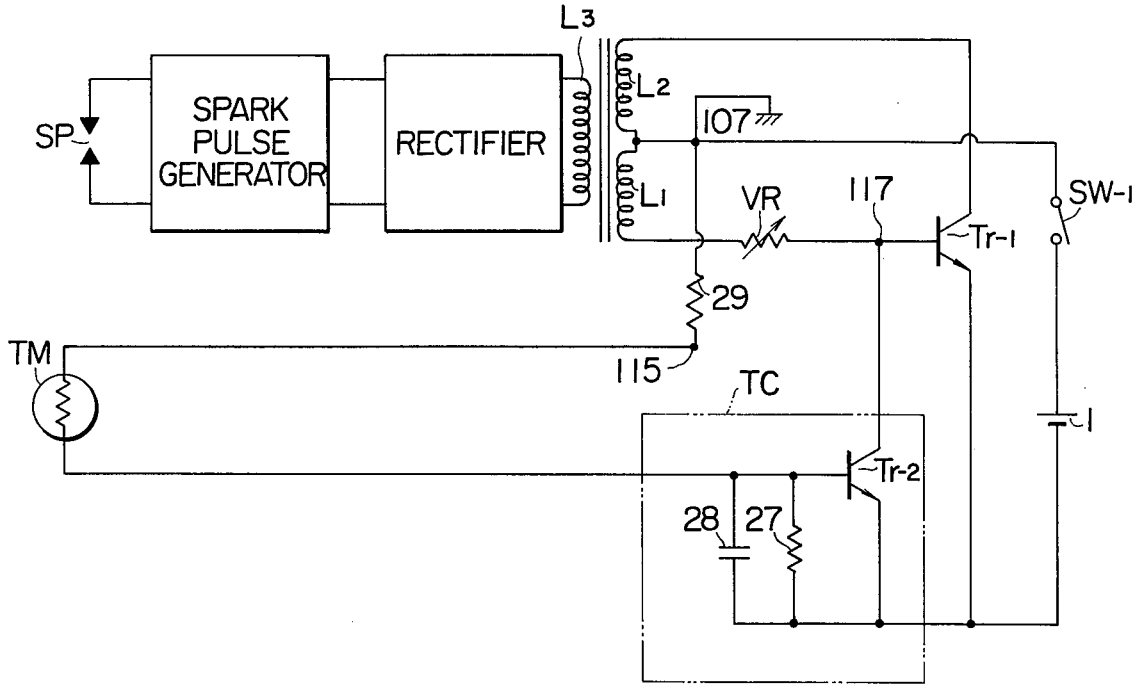
FIG. 4 is a modified electronic circuit from that shown in FIG. 2.

A somewhat modified circuit is shown in FIG. 4. The main timepiece and gas lighter ignition circuit substantially at the upper half of FIG. 4 is similar to that shown in FIG. 2. Thus, in FIG. 4, the main circuit is shown only in a simplified way. As shown, the present modified circuit is added with a time constant circuit TC and a thermister TM. These added parts TC and TM are so designed and arranged to interrupt the spark generation at SP when the gas lighter has been ignited. The circuit TC includes a transistor Tr-2, a resistor 27 and a condenser 28 acting in combination as a time limit defining element as conventionally. These elements and the thermister TM are electrically connected with each other as shown.

With the switch SW-1 cut off as shown, occasionally accumutated electrical charge in the condenser 28 is perfectly discharged through the resistor 27.

When the switch SW-1 is manipulated to on, the condenser 28 is charged through a resistor 29 inserted between junctions 107 and 115 and the resistance at thermister sensor TM held at normal temperatures.

When the charging voltage is designed to be slightly lower than the junction voltage of the base emitter passage of the transistor Tr-2 measured in the forward direction, this transistor can not, therefore, operate normally, while the blocking oscillator BO continues to operate for supplying the necessary operating current to the spark pulse generating circuit. Therefore, sparks are generated periodically at the spark gap and with time intervals of 0.45 second, as an example.

When the gas stream flowing out of a gas nozzle of the gas lighter is ignited in this way, the thermister sensor TM which is positioned in close proximity to the flame, so as to sense at least a lowest temperature of 70° - 80° C, senses the existence of the ignited gas flame. With this sensing operation, the resistance of the thermister will decrease and the electrical charge in the condenser 28 will increase towards a predetermined value which must be higher than the base-emitter voltage, $V_{BE}$, of the transistor Tr-2.

When the condenser charge voltage becomes higher than the said voltage $V_{BE}$, the transistor Tr-2 will be energized to operate, thereby the blocking oscillator BO stopping its oscillating operation.

Figure 5:
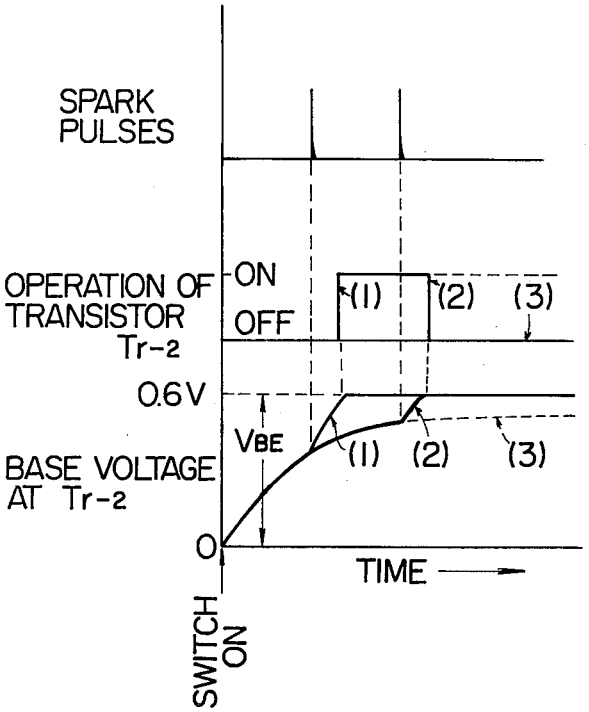
FIGS. 5 and 6 are timing charts of the embodiment shown in FIG. 4.

Now referring to FIG. 5, the above operation can be more easily understood.

In this figure, curves (1) correspond to such operating conditions as appearing when the gas ignition has been made with the first spark pulse. Curves (2) corresponds to a slightly retarded ignition with the second spark pulse. On the other hand, those denoted (3) correspond to a misfired condition, although spark pulse or pulses have been generated. If misfired, next or further spark pulses will be utilized for the ignition purpose.

With the ignition of the gas, the operation of the oscillator transistor Tr-1 will be interrupted and the electrical current at this time will be partially transferred through resistor VR to the collector-emitter passage of transistor Tr-2, and at the same time, part of the current will flow through resistor 29, and thermister TM to the base electrode of the same transistor Tr-2. According to the design of the related circuit elements, the latter current can be set to 1/10 - 1/20 of the working current appearing at the operation stage of the blocking oscillator BO.

When it is desired to ignite the gas lighter lapse of a certain time duration such as 5 - 10 seconds as defined by the time constant of the circuit TC and counted from an extinction of once ignited gas flame of the lighter, during which the thermister sensor TM has recovered its cold state resistance value, a remanipulation of the switch SW-1 to close will suffice for the repetition of the above mentioned operational steps.

Figure 6:
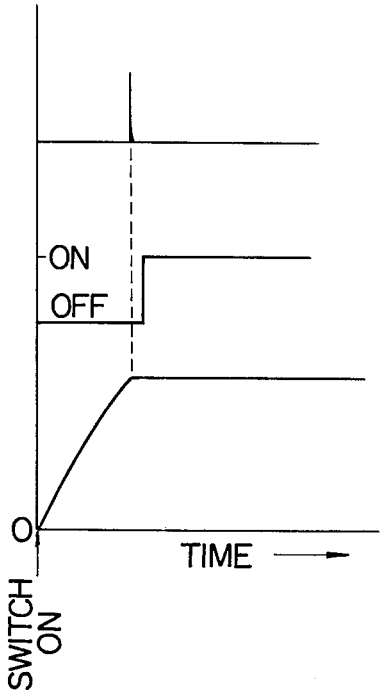

Still a further operation chance as to reinitiate gas ignition instantly upon opening of the switch SW-1 after utilization of the once ignited gas flame could exist. In this case, the thermister sensor TM holds a hot state resistance value which may be considerably lower than its cold state one. By the interruption of switch SW-1, the condenser charge at 28 will be discharged through the parallel resister 27. If the time constant of the circuit TC has been set to a value shorter than that which is necessary to consume for an on-off control of the switch, say 0.5 second as an example, the blocking oscillator BO will continue to operate despite of the short time interruption of the switch SW-1. Therefore, in this case, one or two sparks will be generated at the spark gap SP and the gas stream could be ignited instantly. Thanks to such operational characteristic when adopted in the above mentioned way, the gas lighter can works well even before the thermister sensor TM recovers its cold state. This operational feature is diagrammatically shown in FIG. 6.

Further, there is a further and following operation feature could be provided even where the thermister sensor TM is dispensed with and the lighter operational resistance of the circuit shown in FIG. 4 is set to a value higher than the value $V_{BE}$ of transistor Tr-2, instead of the lower one as above mentioned, spark pulses can be generated at SP and continued for a predetermined time period upon closure of the switch SW-1. In this way, a spark gap ignition type gas lighter fitted with a kind of timer can be provided.

Figure 7:
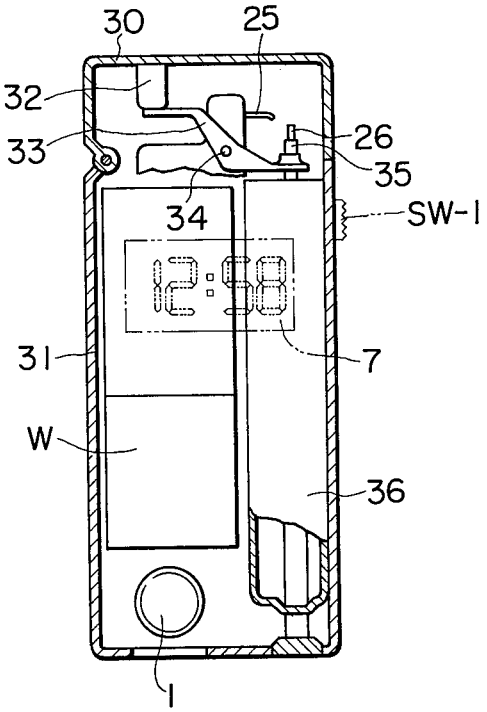
FIGS. 7 - 9 are general outline figures of a preferred embodiment of the assembly according to this invention.
Figure 8:
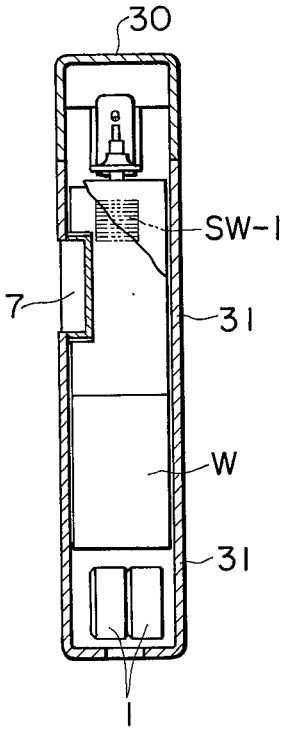
Figure 9:
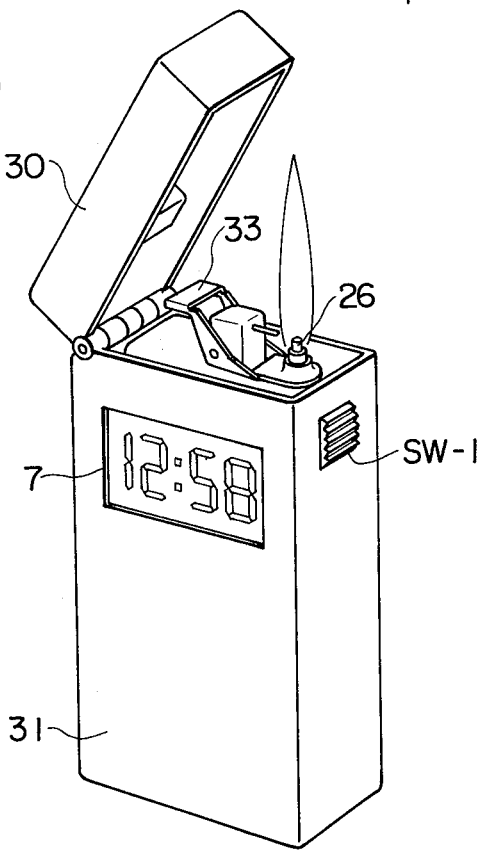

In FIGS. 7 - 9, a preferred embodiment of the invention is shown. FIGS. 7 and 8 represent sectional elevations, while FIG. 9 represents a perspective view. In the latter, a pivotable cap 30 is shown in its opened position, relative to a casing 31. The display 7 has been embodied into a conventional digital one which is mounted in the front wall of the casing 31.

With the cap 30 held at its closed position as shown in FIGS. 7 and 8, a pusher 32 fixedly attached to the cap excerts pressure upon one end of a bell crank lever 33 pivotably mounted at 34 so that the opposite arm end thereof acts upon a gas burner nozzle 35 for keeping the latter at its off-position. Upermost tip end of this nozzle 35 constitutes the spark electrode 26. The opposite spark electrode 25 is seen also in FIG. 7 and in close proximity to the top nozzle end, more specifically its movable valve member.

When the cap 30 is manipulated to its open position as shown in FIG. 9, gas flow will be delivered from a fuel tank 36 containing a quantity of liquefied gas fuel as conventionally. By pushing the button switch SW-1, the gas flow will be ignited as already described hereinbefore, by electrical spark discharge between the electrodes 25 and 26.

The switch SW-1 may be designed into an up-and-down movable slide, in place of a spring-loaded push button.

The modified slide switch SW-1 can be designed to make ignition when it occupies its uppermost position. And, it may make the display 7 on when it is manipulated from upper through middle "off" to its second and lower "on"-position. In this way, both switches SW-1 and SW-2 shown in FIG. 2 can be embodied into a duplicate style.

The modified slide switch SW-1 can be still further modified to have its uppermost "off"-position second and lowermost "on"-position for ignition and for display service, respectively. Or conversely, it may have an uppermost "off"-position, a first and middle "on"-position for display and a second and lowermost "on"-position for ignition, and so on.

In FIG. 2, switches SW-2 and SW-3 are earthed at 116. In FIG. 4, junction 117 is provided in close proximity to base electrode of first transistor Tr-1 for electric connection with second transistor Tr-2 in a branch route.

The embodiments of the invention in which an exclusive property or privilege is claimed are as follows:

1. A unitary electronic digital display watch and liquefied gas-fueled lighter comprising a casing, a watch module mounted within said casing comprising a quartz oscillator, a digital display means for displaying a digital output, and circuit means for interconnecting said quartz oscillator with said digital display means for providing a readout representing the time, a d.c. power source connected to said watch module, and a first switch means connected to said watch module for interconnecting said power source with said watch module, a blocking oscillator, a second switch means for interconnecting said d.c. power source to said blocking oscillator, a step-up transformer having a primary winding and a secondary winding, said primary winding provided at the output of said blocking oscillator, said secondary winding connected to a spark-gap ignition circuit, said spark-gap ignition circuit comprising a pair of electrodes spaced apart to form a spark-gap, means for amplifying a pulse output across said secondary winding to a high-voltage pulse across said spark-gap of sufficient magnitude to ignite an ignitable gas appearing across said spark-gap, means for providing an ignitable gas across said spark-gap, diode means connected between said secondary winding and said pair of electrodes for preventing said high-voltage pulse from passing to said quartz oscillator, and means for positioning said digital display means and said spark-gap in said casing such that the light emitted by the ignited gas across said spark-gap is applied to said digital display means for providing a visual readout of said digital display means.

2. The apparatus of claim 1 wherein said watch module, said primary winding, and said secondary winding are positively grounded.

3. The apparatus of claim 2 wherein said circuit means for interconnecting said quartz oscillator with said digital display means comprises a frequency divider connected to the output of said quartz oscillator, said frequency divider being positively grounded, a power amplifier connected to the output of said frequency divider, a driver connected to the output of said power amplifier, said power amplifier connected to said digital display means.

4. The apparatus of claim 2 wherein said spark-gap ignition circuit further comprises said diode means connected to one end of said secondary winding, a two-directional thyristor connected in parallel with the secondary winding and diode means, a charging capacitor connected in series with said means for amplifying, said charging capacitor and means for amplifying connecting in parallel with said thyristor.

5. The apparatus of claim 4 wherein said means for amplifying comprises a sparking transformer means having a second primary and a second secondary winding, said second secondary winding connected in parallel with said pair of electrodes.

6. The apparatus of claim 1 further comprising interrupt circuit means for interrupting the oscillating output of said blocking oscillator following the gas ignition comprising a thermistor in an RC circuit and means for positioning said thermistor near said spark-gap such that the heat generated by said ignited gas across said spark-gap alters the resistance of said RC circuit, and means for interconnecting said RC circuit with said blocking oscillator for interrupting the oscillating output of said blocking oscillator.

* * * * *